US005083940A

United States Patent [19]

Larson et al.

[11] Patent Number: 5,083,940

[45] Date of Patent: Jan. 28, 1992

[54] CROSSBOX PROTECTION CAP

[75] Inventors: Bruce Larson, Livonia, Mich.; Keith Dawes, Raleigh, N.C.; Robert S. Dubrow, San Carlos, Calif.

[73] Assignee: Raychem Corporation, Menlo Park, Calif.

[21] Appl. No.: 267,065

[22] Filed: Nov. 4, 1988

[51] Int. Cl.[5] ..... H01R 13/52

[52] U.S. Cl. ..... 439/521; 439/276; 439/892

[58] Field of Search ..... 427/44, 358; 156/224; 174/76, DIG. 8; 428/220, 447; 439/519-523, 276, 932, 200, 204, 892; 29/877, 878; 523/455, 466; 524/506, 268, 269

[56] References Cited

U.S. PATENT DOCUMENTS

| | | | |
|---|---|---|---|
| 4,505,976 | 3/1985 | Dochnert et al. | 524/506 |
| 4,511,620 | 4/1985 | Kroupa et al. | 428/220 |
| 4,600,261 | 7/1986 | Debbaut | 439/521 |
| 4,634,207 | 1/1987 | Debbaut | 339/116 C |
| 4,643,924 | 2/1987 | Uken et al. | 428/220 |
| 4,690,831 | 9/1987 | Uken et al. | 427/44 |
| 4,707,515 | 11/1987 | Gilch et al. | 524/506 |
| 4,720,431 | 1/1988 | Wong | 428/447 |
| 4,753,826 | 6/1988 | Lauman | 428/220 |

*Primary Examiner*—David L. Pirlot

*Attorney, Agent, or Firm*—A. Stephen Zavell; Herbert G. Burkard

[57] ABSTRACT

A gel and container means capable of protecting a binding post and drop wire from moisture and corrosion is provided which will effectively prevent the exposure of the drop wire and binding post cap and screw from moisture and corrosive atmospheres without the need for a pressure maintaining means other than the combination of the cap and gel. The pressure of the gel is maintained on the binding post through the extraction of plasticizers from the container means causing a shrinkage.

20 Claims, 1 Drawing Sheet

CROSSBOX PROTECTION CAP

FIELD OF THE INVENTION

The present invention relates to protection of electrical contacts. More specifically, the present invention relates to moisture and corrosion protection of electrical contacts with a protection device containing a moisture and corrosion protecting gel. The invention also relates to methods of protecting an electrical contact and providing a means to retard embrittlement of structural plastics in the electrical contact post. In particular, the invention relates to a gel protection device which maintains the protecting gel under compression through the shrinkage of the gel container.

BACKGROUND OF THE INVENTION

Electrical terminals and especially telecommunication terminals often face moisture and highly corrosive environments. These environments cause premature failure of the electrical connections and result in increased frequency of maintenance along with higher replacement costs of terminals and electrical contacts. U.S. Pat. Nos. 4,600,261, issued July 15, 1986, and U.S. Pat. No. 4,634,207, issued Jan. 6, 1987, solved this problem by covering the terminal with a gel contained in a gel containing means held under pressure over the terminal through a pressure maintaining means such as a nut and bolt, or a split retaining nut. More generally, U.S. Pat. Nos. 4,643,924, issued Feb. 17, 1987 and U.S. Pat. No. 4,690,831 issued Sept. 1, 1987 describe a mirror image conforming case or cap which can optionally stretch-fit over the substrate or alternatively a gel-filled case which can clip around the substrate. The preceding four patents are completely incorporated herein by reference for all purposes.

Although these methods are extremely effective for precluding moisture and corrosive environments from contacting the substrate, not all substrates or terminals and wires provide a means for securing the gel to the terminal post and wire or around the substrate. For example, certain terminal post and wire combinations may present a shape which is too irregular to be protected unless it is fully encased by gel which may be impractical or impossible. Thus, it would be highly desirable to have a gel-in-case means capable of maintaining pressure on the gel over an irregular substrate or combination of parts without fully encasing them such as a terminal post wire combination without a separate retaining means. It would also be desirable to have a case and gel combination which can set up an equilibrium situation with the substrate to avoid or minimize embrittlement thereof.

SUMMARY OF THE INVENTION

The inventions embodiments provide the previously recited desirable features as well as other features readily apparent d to the ordinary skilled artisan. The invention resides in the surprisingly unexpected discovery that the interaction of gel formulations in combination with a highly plasticized gel containing means causes an out-migration of plasticizer from the plasticized containing means and into the gel which produces a shrinkage of the containing means when said means is applied around an irregular shape such as a terminal post and wire combination, e.g., a crossbox binding post wire combination. The extraction of the plasticizer from the container means causes the containing means to shrink and thus retain the gel under sealing compression with the terminal post.

The increased absorption of plasticizer by the gel also provides a means for an equilibrium distribution of plasticizer between the gel and the substrate to minimize either softening or embrittlement of the substrate. This equilibrium reaction can be enhanced with an alternative embodiment which includes forming a gel with a finely divided support matrix containing plasticizer such as highly plasticized plastics, e.g., plastisol to balance any out-migration of plasticizer from the substrate.

DETAILED DESCRIPTION OF THE INVENTION

Figure 1:
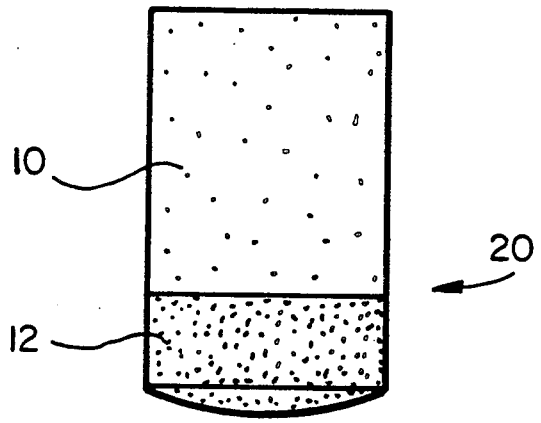
FIG. 1 illustrates a cross-sectional view of a containing means such as a binding post cap containing a gel.
Figure 2:
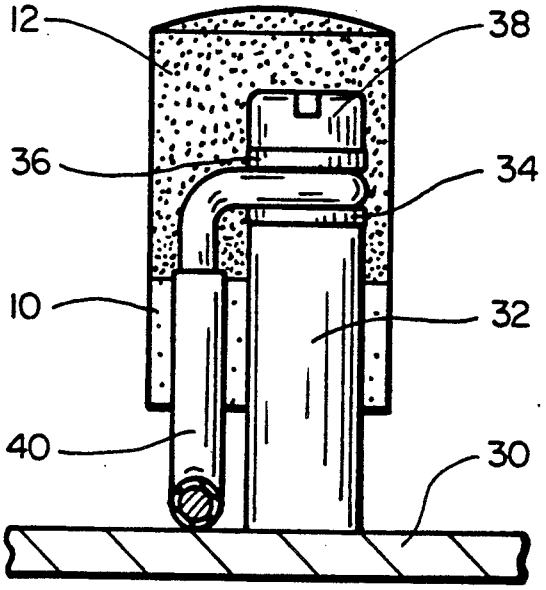
FIG. 2 is a cross-sectional view of the gel containing post cap applied to a binding post terminal.

The invention will be more particularly described by reference to the attached Figures. More specifically, FIG. 1 illustrates the gel and the gel containing means 20. The containing means 20 such as a cap is nonconforming with the substrate, i.e., not a mirror image, because the substrate shape precludes a mirror image shape. More specifically, the cap 10 contains a sufficient amount of a gel 12 to protect the parts on the substrate requiring protection. The cap 10 can be fabricated from any material capable of releasing plasticizer into the gel 12 upon positioning of the cap onto a substrate such as a binding post wire combination. Suitable examples of plastics are flexible, highly plasticized PVC often referred to as plastisol and the like. A suitable cap 10 can be purchased from the Polaris Company of Compton, California under the part number PM203H. Since the gel cures more quickly at elevated temperatures, e.g., about 85° C., high temperature caps are preferred.

The gel 12 can be any suitable gel having a cone-penetration as recited in the aforementioned patents, i.e., a cone-penetration of about 50 to about 350 ($10^{-1}$ mm) with an ultimate elongation in excess of 100% and preferably in excess of about 200%. A preferred gel exhibits a cone of from about 200 to about 300 ($10^{-1}$ mm) and most preferable gel has a cone penetration of from about 225 to about 280 ($10^{-1}$ mm). The gel is selected to be able to remove sufficient plasticizer from the cap 10 to cause sufficient shrinkage to maintain the cap on the substrate. A suitable gel is a urethane gel, a silicone gel, or mixtures thereof. Silicone gels are preferred.

A particularly preferred gel is a poly-di-methyl siloxane. The gel is about 40% of a cross-linked poly-di-methyl siloxane and about 60% of a lower molecular weight poly-di-methyl siloxane oil. More specifically, the gel may be fabricated by mixing appropriate amounts of silane-hydride and poly-di-methyl siloxane. These preferred gels are commercially available as Dow Corning 527 gel or Shin-etsu Ke 104 gel. Alternatively the gels can be made via a chemical cross-linking, for example through mixing, in the presence of a Pt catalyst, of a vinyl containing siloxane preploymer, siloxane containing silicon bonded hydrogen atoms, and poly-di-methyl siloxane fluid as an extender.

The cap and gel 20 is sized to fit reasonably snugly over a binding post 32 connected to a base 30 having metallic washers 34 and 36 opposite a wire 40 attached to the binding post 32 by a screw 38. A reasonably snug fit is defined as a fit which is sufficient to initially maintain the cap in contact with the substrate although not permanently without a further shrinkage of the cap. The binding post 32 and/or the outer jacket on wire 40 are fabricated from a stiff polyvinylchloride. In the process of fitting over the binding post/screw 32/38 and the drop wire 40, the gel 12 covers a greater surface area within the cap 10 than when initially cured within the cap 10. The spreading of the gel withdraws plasticizer from the cap 10 causing a hardening thereof as a result of shrinkage of the cap 10 to provide the continued pressuring means to maintain the gel under compression and provide moisture resistance and corrosion protection. A flexible PVC cap, i.e., plastisol, in the absence of plastisol particles in the gel, exhibits about a 60% hardening in contact with the aforementioned silicone gel and also some shrinkage to maintain pressure on the gel. Any suitable cap and gel combination is possible provided that the cap does not absorb oil from the gel causing a softening thereof rather than hardening and an excess withdrawal of plasticizers to embrittle and crack the cap.

In an alternative embodiment, an additional source of plasticizer such as support matrix containing the plasticizer is incorporated into a gel to maintain an equilibrium of the plasticizer within the gel and the substrate at elevated temperatures, e.g., greater than 30° C. or higher, to avoid the removal of plasticizer from the substrate. Removal of plasticizer from the substrate can cause embrittlement which can increase maintenance and cause premature substrate failure.

A suitable source of plasticizer is finely ground up plastisol. Plastisol is defined as a substance comprising a mixture of a resin and a plasticizer that can be molded, cast, or made into an object or a continuous film by the application of heat. The plastisol is preferably ground to a powder-like consistency, e.g., from about 0.0001 microns to about 100 microns particle size and preferably about 0.001 microns to about 25 micron particle size. The amount is controlled to avoid softening of the cap and base thereof but in an amount sufficient to avoid embrittlement of the low plasticizer system components such as the wire and terminal post. A sufficient amount is from about 0.001 grams to about 0.5 grams per gram of gel.

Of course the gel support matrix combination must withdraw sufficient plasticizer from the cap to cause a shrinkage of the cap in the preferred embodiments containing no additional pressure maintaining means but for more general embodiments when the container means is maintained under pressure, the gel can contain greater amounts of the support matrix and plasticizer to be optimized for substrate life. Preferably the plasticizer is selected to match the plasticizer in the substrate.

Having described the preferred embodiments of the invention, modifications which would be obvious to one of ordinary skill in the art are contemplated to be within the scope of the invention.

We claim:

1. A corrosion protection device comprising:

a gel containing means for containing a gel; and a gel contained therein, said gel and gel containing means cooperate in combination to cause a migration of plasticizer from the gel containing means and into the gel which results in a shrinkage of the gel containing means upon pressing of the gel containing means onto a substrate, said shrinkage is sufficient to cause the gel containing means to maintain the gel in contact with the substrate under compression.

2. The device according to claim 1 wherein the gel containing means has a nonconforming shape to the shape of the substrate.

3. The device according to claim 2 wherein the gel is selected from a urethane gel or a silicone gel or mixtures thereof.

4. The device according to claim 2 wherein the gel containing means is plastic.

5. The device according to claim 4 wherein the plastic is a flexible highly plasticized polyvinylchloride.

6. The device according to claim 4 wherein the gel containing means is plastisol.

7. The device according to claim 7 wherein the gel is a silicone gel.

8. The device according to claim 7 wherein the gel is a poly-di-methyl siloxane gel.

9. The device according to claim 1 wherein the gel is a cured gel having a cone penetration of about 50 to about 350 (10−1 mm) with an ultimate elongation in excess of about 100%, the gel including a source of a finely divided matrix containing a plasticizer therein with the gel.

10. The device according to claim 9 wherein the gel has a cone penetration of about 200 to about 300 (10−1 mm) with an ultimate elongation in excess of about 200%.

11. The device according to claim 9 wherein the matrix if from about 0.0001 grams to about 0.5 grams per gram of gel.

12. The device according to claim 11 wherein the matrix has a particle size of from about 0.0001 microns to about 100 microns.

13. The device according to claim 12 wherein the matrix containing a plasticizer is plastisol.

14. The device according to claim 13 wherein the gel is a silicone gel.

15. The device according to claim 14 wherein the silicone gel is a poly-di-methyl siloxane gel.

16. A method of maintaining a gel containing means for containing a gel in contact with a substrate to be protected comprising:

curing a gel within a gel containing means;

placing the gel containing means in contact with the substrate to be protected with a sufficient initial force to cause a displacement of the gel within the containing means sufficient to cover an area of the containing means greater than prior to placement over the substrate wherein said gel extracts an ingredient from the containing means whereby the containing means undergoes a shrinkage to maintain the gel within the containing means in contact with the substrate.

17. The method according to claim 16, wherein the cured gel has a cone penetration of about 50 to about 350 (10−mm) with an ultimate elongation in excess of 100%.

18. The method according to claim 16 wherein the initial force is less than the amount of force capable of causing a loss of gel out of the containing means.

19. The method according to claim 18 further comprising adding a source of plasticizer within a support matrix into the gel.

20. The method according to claim 19, wherein the cured gel has a cone penetration of from about 50 to about 350 (10−mm) with an ultimate elongation in excess of 100%.

* * * * *